US007960633B1

(12) United States Patent
Chen

(10) Patent No.: US 7,960,633 B1
(45) Date of Patent: Jun. 14, 2011

(54) ANTI-ROTATION COUNTERHOOP-FIXING STRUCTURE FOR DRUM

(76) Inventor: Chang-Hui Chen, Taichung Hsien (TW)

( * ) Notice: Subject to any disclaimer, the term of this patent is extended or adjusted under 35 U.S.C. 154(b) by 0 days.

(21) Appl. No.: 12/691,724

(22) Filed: Jan. 21, 2010

(51) Int. Cl.
*G10D 13/02* (2006.01)

(52) U.S. Cl. ..... 84/413; 84/411 R

(58) Field of Classification Search ..... 84/411 R, 84/413, 422.1
See application file for complete search history.

(56) References Cited

U.S. PATENT DOCUMENTS

| | | | | |
|---|---|---|---|---|
| 3,332,464 | A * | 7/1967 | Castel | 411/155 |
| 4,034,788 | A * | 7/1977 | Melone | 411/134 |
| 5,584,410 | A * | 12/1996 | Siblik | 220/320 |
| 5,773,736 | A * | 6/1998 | Hsieh | 84/422.1 |
| 5,804,747 | A * | 9/1998 | Chen | 84/327 |
| 6,018,116 | A * | 1/2000 | Simons et al. | 84/411 R |
| 6,459,026 | B1 * | 10/2002 | Bozzio | 84/411 R |
| 6,492,583 | B1 * | 12/2002 | Wilkey | 84/413 |
| 6,686,527 | B2 * | 2/2004 | Hagiwara | 84/413 |
| 6,749,386 | B2 * | 6/2004 | Harris | 411/544 |
| 6,891,100 | B2 * | 5/2005 | Crouch | 84/421 |
| 7,307,204 | B2 * | 12/2007 | Ito | 84/411 R |
| 7,402,740 | B2 * | 7/2008 | van der Meulen | 84/413 |
| 7,692,084 | B1 * | 4/2010 | Lai | 84/422.1 |
| 7,754,953 | B2 * | 7/2010 | Takegawa | 84/422.1 |
| 7,855,331 | B1 * | 12/2010 | Chen | 84/422.1 |
| 2007/0131087 | A1 * | 6/2007 | Chen | 84/411 R |

* cited by examiner

*Primary Examiner* — Jeffrey Donels
*Assistant Examiner* — Robert W Horn
(74) *Attorney, Agent, or Firm* — Leong C. Lei

(57) ABSTRACT

An anti-rotation counterhoop-fixing structure is provided for a drum, which realizes secured and reliable fastening of the counterhoop, wherein a fastening end face of a drum-fastening screw and a fastening face of the counterhoop are respectively provided with roughened anti-skidding patterned surfaces so that when the screw is tightened for fastening, the anti-patterns provided on the mated fastening faces effectively prevent the threaded engagement from getting loosened when the drum is beaten or batted. Thus, secured and reliable adjustment and fastening of the drum skin can be realized, which maintains perfect and intact sound of drum beating and facilitates convenience and practicability of operation and use of music instrument percussion.

2 Claims, 3 Drawing Sheets

ANTI-ROTATION COUNTERHOOP-FIXING STRUCTURE FOR DRUM

(a) TECHNICAL FIELD OF THE INVENTION

The present invention generally relates to an anti-rotation counterhoop-fixing structure for a drum, wherein a counterhoop threaded hole seat for securing a skin of a drum and a corresponding fastening end face of a tension screw are respectively provided with anti-skidding patterned surfaces so that in the operation of fastening the drum skin, with the roughened anti-skidding design of the anti-skidding patterns, secured fastening for safe use resulting from anti-loosening fastening of the drum skin is realized.

(b) DESCRIPTION OF THE PRIOR ART

To fasten a drum skin to a drum shell, a counterhoop is used to effect securing and fastening of the skin, so as to realize positioning of the skin and fastening and adjustment of tension. To suit the need for the sound generation required in practically hitting a drum, the fastening set between a drum counterhoop and a drum skin are arranged as shown in FIG. 6, wherein a top opening rim of a drum shell 30 is provided with a thin membrane of drum skin 31 that is stretched and held by a counterhoop 32. Fastening pieces 33 are circumferentially arranged around the shell 30 to respectively engage tension screws 35 extending through holed fastening seats 34 formed around the counterhoop 32 and mating the fastening pieces 33 to serve as fastening means for fixing the skin 31 and to also serve as fastening means for adjusting stretching tension of the skin 31 to change and adjust the sound generated by hitting the drum skin. Such a known fastening set is disadvantageous in that the tightness of the fastened tension screw 35 is often affected by the vibration induced by hitting the drum, which makes the screwed tightness loosened due to reverse rotation caused by drum vibration, leading to loosening after fastening, which directly affects the sound generation of the drum skin 31. Thus, it requires often re-tightening the tension screw 35 to re-adjust the tightness of fastening the skin 31 for maintaining desired sounding of the drum. This is very inconvenient and may affect the performance in a concert when the drum may be put in use of a long time without being paid attention to for the loosening condition and as a result, the quality of drum batting or beating or the whole performance deteriorates. A major reason is that the mated fastening surfaces within the fastening set are conventionally made smooth. Although spring washer may be provided, yet the engagement is still made between smooth surfaces. Thus, when beating or batting the drum leads to violent vibration, the fastened tension screws are caused to loosen due to the vibration. It is desired to provide a fastening and adjustable tightening structure for a drum skin in order to overcome the conventional problems and the suit the practical needs for drums.

SUMMARY OF THE INVENTION

In view of the above discussed drawbacks in insufficiency of stability in adjustment of fastening a drum skin, the present invention aims to provide an anti-rotation fixing structure for drum counterhoop that provides roughened anti-skidding patterned surfaces on mated fastening surfaces, whereby with the engagement between the roughened surfaces, the concern of reverse rotation and skidding occurring after fastening can be eliminated. The drawback of impracticability due to loosening caused by vibration for the known ways of assembling and fastening can be substantially improved.

A primary objective of the present invention is to realize secured and loosening- and skidding-resistant fastening by providing similar roughed anti-skidding patterned surfaces to a fastening end face of a screw and an end face of a holed fastening seat of a drum counterhoop, whereby secured, safe, and reliable adjustment for fastening operation can be realized for fastening a drum skin.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention will now be explained with reference to the drawings.

Figure 1:
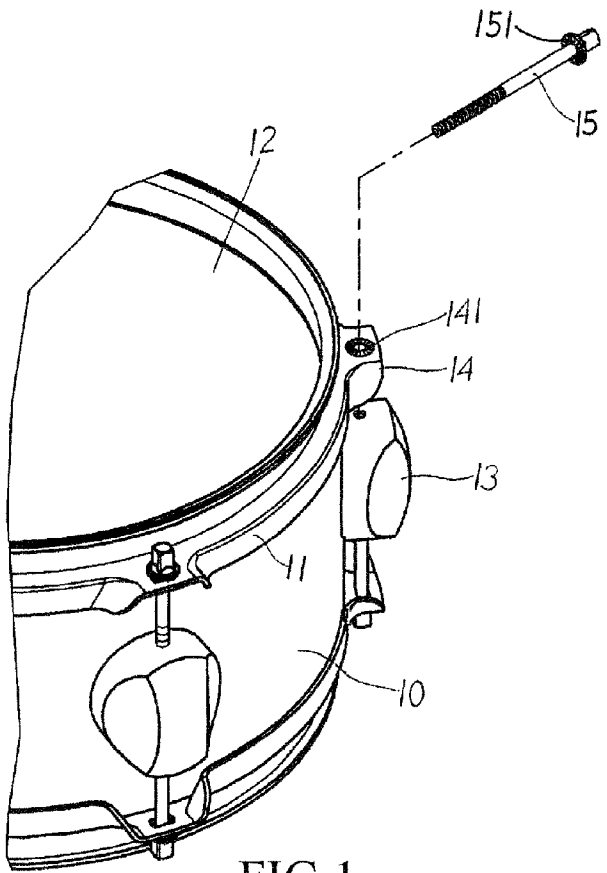
FIG. 1 is an exploded view illustrating fastening drum counterhoop.
Figure 2:
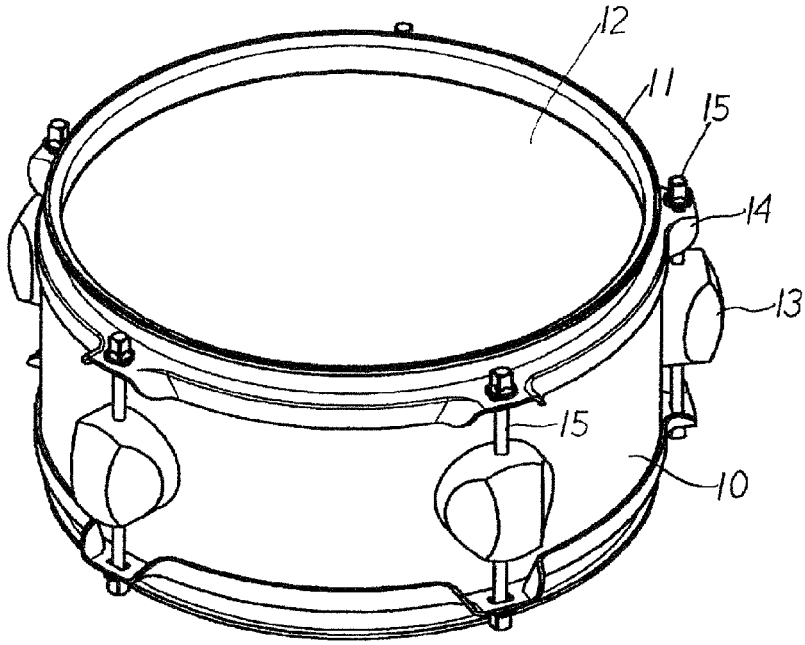
FIG. 2 is a perspective view illustrating the fastened drum counterhoop.

The present invention provides anti-rotation counterhoop-fixing structure for a drum, of which an embodiment is particularly shown in FIGS. 1 and 2. In the assembling of a shell 10 of a drum, an open end of the shell 10, which is generally circular, is fixed with a head or a skin 12 by means of a counterhoop 11. A plurality of fastening pieces 13 is circumferentially set around a cylindrical surface of the shell 10, preferably in an equally-spaced manner, and the counterhoop 11 is provided with a plurality of holed seats 14 to each receive a tension screw 15 that is located outside the shell and extends through the holed seat 14 to engage the respective fastening piece 13 so as to effect fastening of the skin and to adjust and change the sound generated by the skin 12 by applying different tensioning forces thereto. To meet the need for eliminating skidding and reversal rotation of the fastening set, a circumferential fastening-effected rim-like surface of the hole defined in the holed seat 14 is formed with serrated anti-skidding patterned surface face 141, by which a roughened face is formed to assist positioning for the fastening set. Similarly, to actually effect the fixed fastening, a fastening-effected engaging face of the tension screw 15 is also provided with a similarly-structured rough anti-skidding face 151, whereby when the screw 15 is inserted through the fastening-effected surface of the holed seat 14, the corresponding rough anti-skidding patterned surfaces 141, 151 formed on the two fastening-effected surfaces may effectively secure the screw 15 and prevent reverse rotation and loosening caused by the vibration of the skin being hit, and thus realizing secured fastening between the counterhoop 11 and the skin 12.

Figure 3:
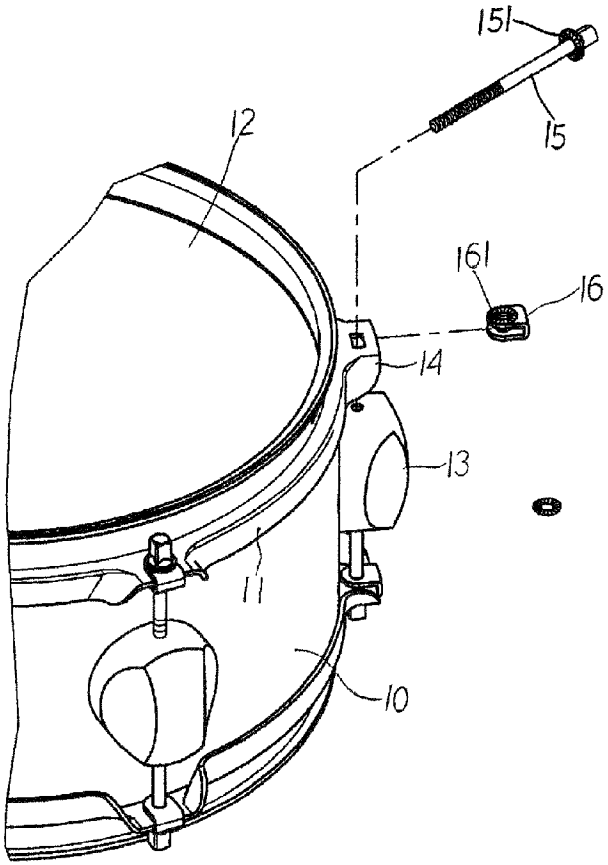
FIG. 3 is an exploded view illustrating a different way of fastening drum counterhoop.
Figure 4:
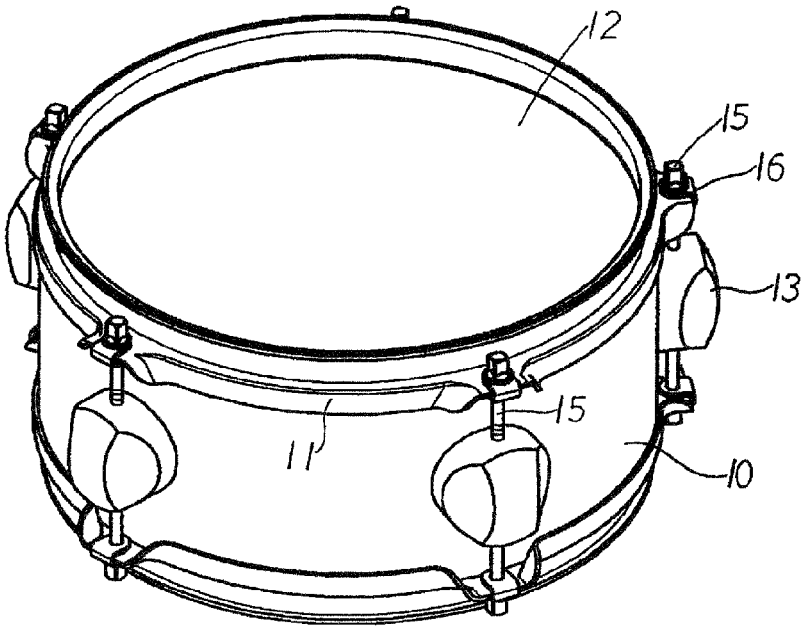
FIG. 4 is a perspective view illustrating the fastened drum counterhoop of FIG. 3.
Figure 5:
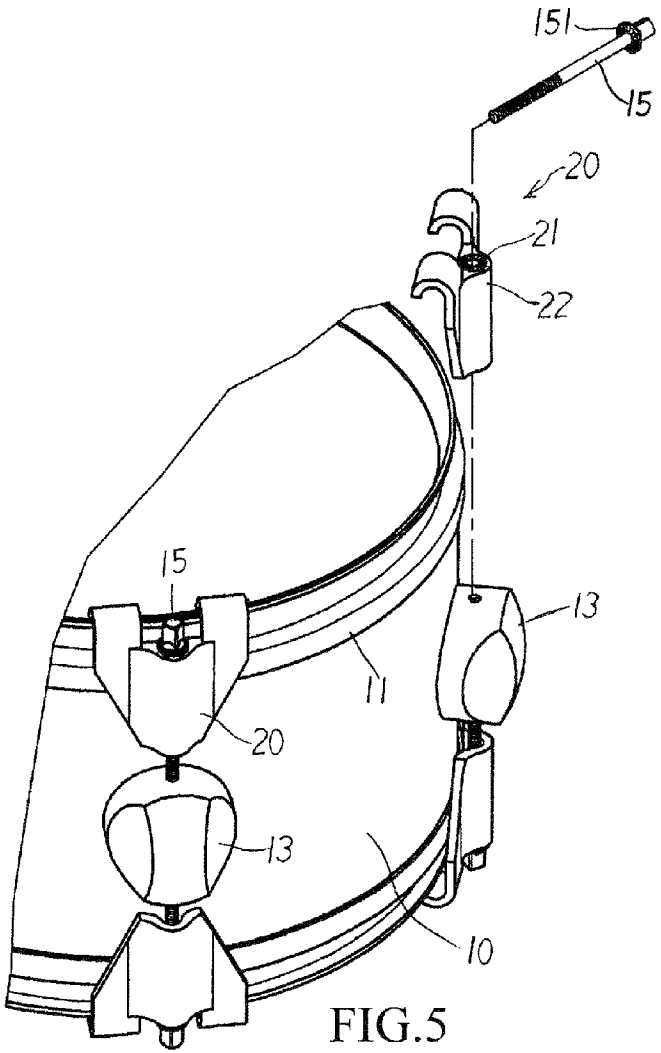
FIG. 5 is an exploded view illustrating a further different way of fastening drum counterhoop.
Figure 6:
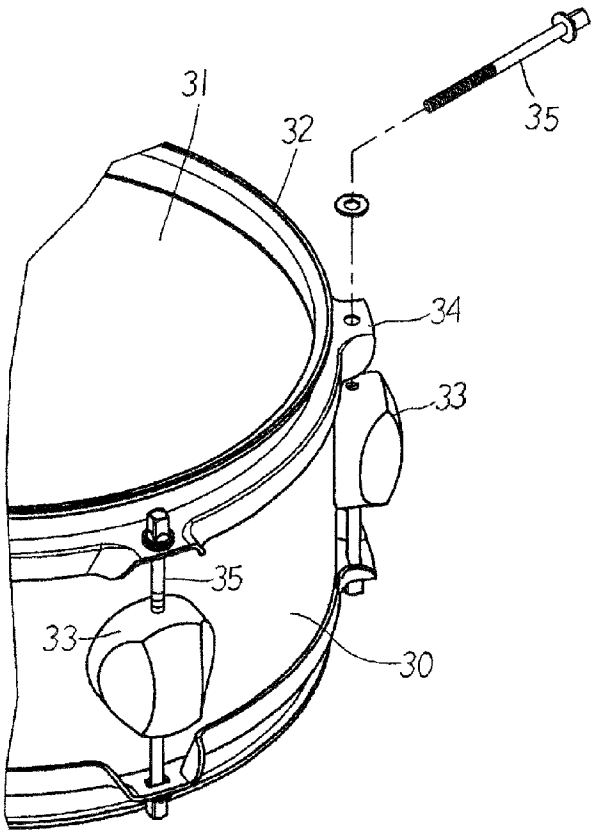
FIG.6 PRIOR ART
FIG. 6 is an exploded view illustrating a conventional way of fastening drum counterhoop.

The present invention provides an arrangement of anti-skidding patterned surfaces 141, 151 to facilitate fastening, wherein roughened anti-skidding patterns are provided on the tension screw 15 and the end face of a hole rim of the drum counterhoop 11 based on the need of fastening operation in fastening the counterhoop 11 and the drum skin 12, so that effective and secured fastening and prevention of reverse rotation can be realized after the fastening operation is completed. Yet, as shown in FIGS. 3 and 4, alternatively, a washer or pad 16 that is provided to be directly set on the hole rim of the fastening seat with an anti-skidding patterned surface 161 formed on an end face of the fastening pad or washer. Again, a similar fastening arrangement featuring roughened anti-skidding effect is provided. This is also within the scope of the present invention. Alternatively, as shown in FIG. 5, a fastening seat 20 is provided for a hooked counterhoop 11, wherein a roughened anti-skidding surface 21 that functions to prevent undesired skidding, is simply provided on a top side fastening face of a holed seat 22 for cooperating with a corresponding roughened face formed on a penetration end of the tension screw 15 to effect the secured mutual fastening. The roughened patterned surface for anti-skidding can be formed with saw-toothed like configuration and/or lined-up rib arrangement to effect an interfering fastening engagement between the upper- and lower-side patterns for fastening, whereby vibration-resisting and anti-skidding fastening effect can be realized to properly maintain the secured condition of the counterhoop 11 and to eliminate the drawback of ineffective fastening in the conventional drum skin 12 caused by improper fastening that calls for frequent adjustment and fastening and thus simplifying the convenience and stability of adjustment and fastening of drum skin.

To summarize, the anti-rotation counterhoop-fixing structure for drums in accordance with the present invention employs roughened anti-skidding patterned surfaces respectively on opposing engaging surfaces of the tension screw that functions for fastening and an end face of a through hole defined in the counterhoop to allow the mated fastening engagement between the roughened surfaces to realize the anti-loosening effect that prevents reverse rotation and skidding caused by vibration.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An anti-rotation counterhoop-fixing structure for a drum comprising a shell and a counterhoop for securing a skin to the shell and a plurality of fastening pieces and respective screws circumferentially set around the shell for fastening purposes, wherein the counterhoop comprises fastening holed seats corresponding to the fastening pieces and each defining a hole having a fastening end face, and each screw has a fastening engaging end face, both end faces forming serrated anti-skidding patterned surfaces to provide roughened surfaces for facilitating fastening and positioning, whereby after being fastened, the screw is prevented from reverse rotation and loosening and fastening of the skin is made effective and secured.

2. The anti-rotation counterhoop-fixing structure according to claim 1, wherein a counterhoop fastening washer and a fastening end face of each screw are provided with roughened anti-skidding patterned surfaces.

* * * * *